US005651655A

United States Patent [19]

Fulbright

[11] Patent Number: 5,651,655

[45] Date of Patent: Jul. 29, 1997

[54] PARTICULATE CARGO CONTAINER SUPPORT AND METHOD OF USING

[76] Inventor: Jerry Wayne Fulbright, 5346 Hillsight, Parchment, Mich. 49004

[21] Appl. No.: 740,150

[22] Filed: Oct. 28, 1996

[51] Int. Cl.[6] ..... B60P 1/64

[52] U.S. Cl. ..... 414/498; 414/572; 414/786; 248/141

[58] Field of Search ..... 414/338, 389, 414/498, 572, 786; 248/139, 141, 370

[56] References Cited

U.S. PATENT DOCUMENTS

| | | | |
|---|---|---|---|
| 364,652 | 6/1887 | James et al. . | |
| 1,785,168 | 12/1930 | Young | 414/389 X |
| 2,044,592 | 6/1936 | Richards | 414/338 X |
| 2,959,389 | 11/1960 | Richter et al. . | |
| 3,180,511 | 4/1965 | Huisman | 414/498 |
| 3,180,601 | 4/1965 | Belt | 414/498 X |
| 3,198,395 | 8/1965 | McKinney | 248/139 X |
| 3,623,621 | 11/1971 | Tarrant | 414/498 X |
| 3,663,051 | 5/1972 | Yu . | |
| 3,677,194 | 7/1972 | Barry . | |
| 3,744,652 | 7/1973 | Rieschel . | |
| 3,790,090 | 2/1974 | Lorenc et al. . | |
| 4,343,404 | 8/1982 | Folsom . | |
| 5,263,687 | 11/1993 | Garbiso . | |

FOREIGN PATENT DOCUMENTS

| | | | |
|---|---|---|---|
| 2223220 | 4/1990 | United Kingdom | 414/389 |

*Primary Examiner*—Karen B. Merritt
*Assistant Examiner*—Stephen Gordon
*Attorney, Agent, or Firm*—Flynn, Thiel, Boutell & Tanis, P.C.

[57] ABSTRACT

A particulate cargo container support apparatus having plural pairs of side-by-side laterally spaced upright post members rotatably supporting shaft members extending therebetween. Hook members are positioned on the rotatable shaft member so as to be movable out of the path of a container on a raised truck bed when the truck is positioned under the support apparatus. A control device in the form of a manually operable handle is connected to an end of the shaft member for effecting the rotation of the shaft member and hook members into and out of the path of the container on the truck bed. The hook members engage the container on the truck bed when the truck bed is lowered. When the truck bed is fully lowered, a vertical, separation between the container and the truck bed is effected. The container is then fully supported on the support apparatus and the truck is free for other uses.

12 Claims, 7 Drawing Sheets

PARTICULATE CARGO CONTAINER SUPPORT AND METHOD OF USING

FIELD OF THE INVENTION

The present invention relates to a particulate cargo container support apparatus and a method for removing the container from a truck bed, more particularly, the invention relates to a support apparatus for truck mounted road salt spreader and method for removing the spreader from the truck utilizing the motive force applied by the truck for raising and lowering the truck bed.

BACKGROUND OF THE INVENTION

Particulate cargo containers, especially road salt/sand spreaders, are usually mounted on the beds of large trucks. These spreaders generally cover the entire truck bed, or at least render the truck bed unavailable for other uses. The truck is thus restricted to applying salt to roadways when the spreader is mounted thereon. While applying salt to roadways is an important function during inclimate periods of the winter months, leaving the spreader on the truck during good weather periods of the winter months idles the truck for other purposes, which is a significant waste of resources. It is desirable to remove the spreader from the truck during good weather periods of the winter months and the nonwinter months, and particularly when the spreader is not in use. Large hydraulically powered lifts, for example front end loaders, may be used to place the spreader in the truck bed. However, hydraulic lifts introduce further drawbacks due to their complexity, expense, and the extensive maintenance required to ensure that a hydraulic lift remains operational. Electric motors may also be used as lifts. If an electric lift is relied on during the winter months, it may not have a reliable electric power source due to storm activity. Conventional lifts remove the spreader from a truck and then lower the spreader to the ground. When the spreader is placed back onto the truck, the lift must be available to lift the spreader from the ground to effect placement of the spreader back onto the truck.

The use of conventional lifts may also require an operator to climb up onto at least the truck bed, and possibly into the spreader itself to secure the spreader to the hydraulic or electric lift, for example to attach a chain from the lift to the spreader. Climbing onto equipment is a safety hazard to the user. The operator must also be trained in the operation of the lift in addition to the operation on the truck and spreader. Additionally, in the case of a front end loader being the lift, the front end loader must remain at the site with the spreader so that it is available when the spreader is to be mounted on the truck.

Conventional methods for removal of a spreader from a truck usually adapt a conventional lift, designed for other purposes, to remove and replace the spreader on the truck. Conventional methods require the purchase of additional heavy equipment and training in how to operate the heavy equipment.

It is an object of this invention to provide a particulate cargo container support apparatus which is relatively inexpensive and simply relies on the motive force applied to the truck bed by devices on the truck to remove the particulate cargo container therefrom, in addition to addressing the drawbacks of the conventional lifts.

It is a further object of the invention to provide an improved method for removing a particulate cargo container from a truck bed and supporting the same utilizing the motive force of the devices on the truck for raising and lowering the truck bed.

It is a further object of the invention to provide a particulate cargo container support apparatus which is operable by a single person.

SUMMARY OF THE INVENTION

The objects and purposes of the invention are met by providing a particulate cargo container support apparatus which has plural pairs of side-by-side laterally spaced upright post members rotatably supporting shaft members extending therebetween. Hook means are positioned on the rotatable shaft members so as to be movable out of the path of a container positioned on a truck bed when the truck is positioned under the support apparatus. A control device in the form of a manually operable handle is connected to an end of the shaft member for effecting the rotation of the shaft member and hook means into and out of the path of the container on the truck bed. The hook means engage the container on the truck bed when the truck bed is lowered. When the truck bed is fully lowered, a vertical separation between the container and the truck bed is effected. The container is then fully supported on the support apparatus and the truck is free for other uses.

BRIEF DESCRIPTION OF THE DRAWINGS

Further objects and purposes of the invention will be apparent to persons acquainted with apparatus of this general type upon reading the following description and reviewing the accompanying drawings, in which.

DETAILED DESCRIPTION

Figure 1:
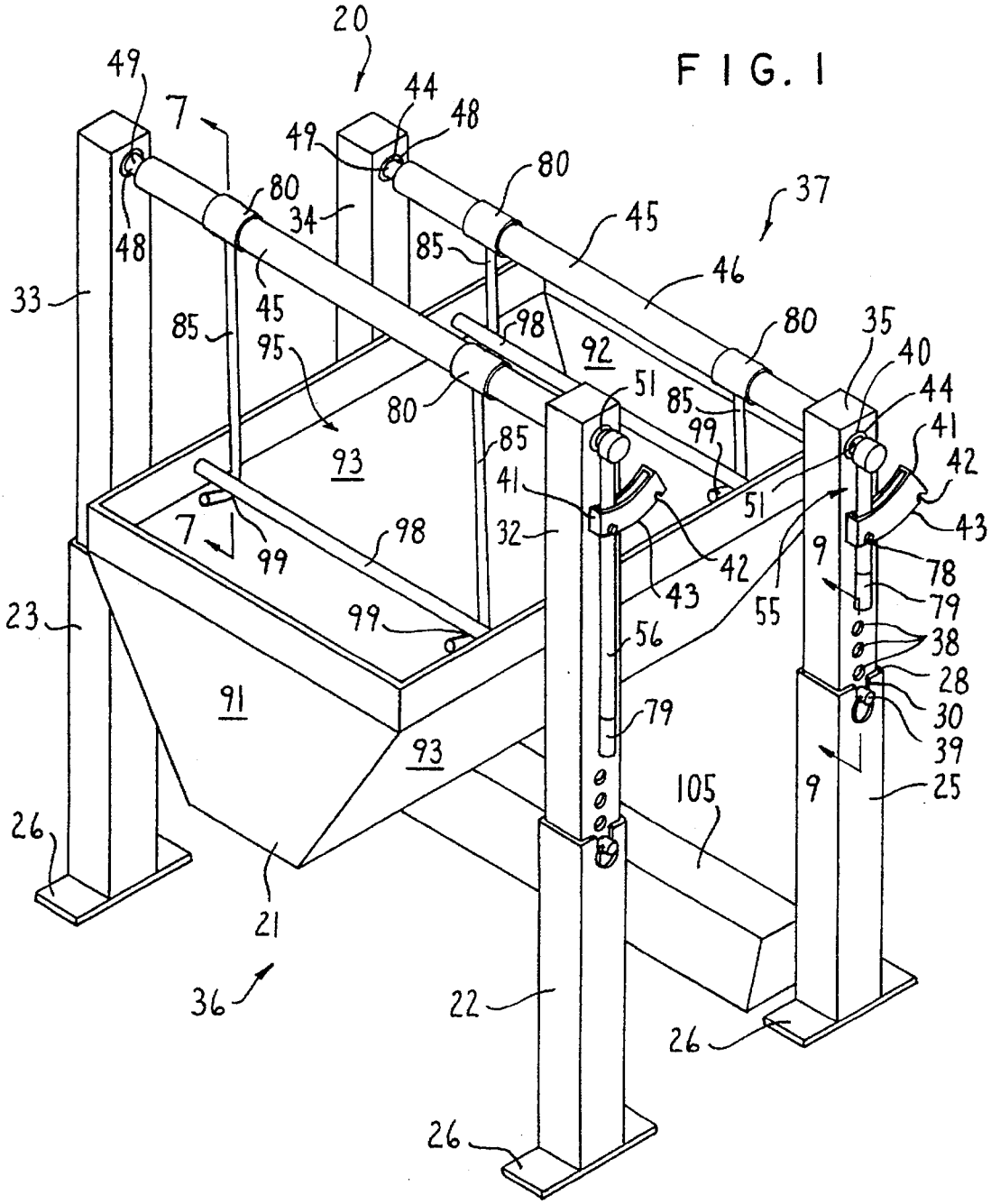
FIG. 1 is a top, front isometric view of the particulate cargo container support apparatus and a container supported thereon.

FIG. 1 shows a support apparatus 20 supporting a conventional particulate cargo container 21. The container 21 is particularly adapted to spread a particulate onto a road, the particulate being salt, sand, or a combination thereof. The support apparatus 20 includes, in this embodiment, four lower upright members or posts 22, 23, 24, 25 which stand upright on a floor surface or on the ground. Each lower post member is hollow and has a rectangular or square cross section. Since the lower post members 22, 23, 24, 25 are otherwise identical in structure, only one post member 25 will hereinafter be described in detail. A flat plate 26 is secured, as by welding or other conventional means, to the lower end portion of the lower post member 25. Other arrangements for stabilizing the post member are deemed to be within the scope of this invention, for example bracing members extending between adjacent pairs of the upright posts 22, 25 and 23, 24. A top edge 28 of the post member has diametrically opposed, horizontally aligned, notches 30 recessed therein.

The support apparatus 20 additionally includes four hollow upper post members 32, 33, 34, 35, each of which is at least partially received within a hollow interior 27 of a respective lower post member 22, 23, 24, 25. The cross sectional shape of each upper post member is conformed to the cross sectional shape of the interior of the lower post members. Since the upper post members 32, 33, 34, 35 are identical in structure, only one upper post member 35 will hereinafter be described in detail. A plurality of vertically spaced, horizontally aligned, apertures 38 extend through a lower portion of the upper post member 35. The apertures 38 are each vertically aligned with the notches 30 in the upper edge of the lower post member 25 when the upper post member 35 is received in the lower post member 25. A securement pin 39 conforming in shape to the shape of the apertures 38, here circular, is received in a selected one of the set of horizontally aligned apertures 38. The securement pin 39 extends outwardly from opposite sides of the upper post member 35. The securement pin 39 secures the upper post member 35 relative to the lower post member 25 by being adapted to press against the lower surface of the notches 30 in the lower post member 25 and the upper surface of the apertures 38 when the upper post member 35 is received in the lower post member 25. The upper post member 35 additionally has a further horizontally aligned aperture set 40 extending therethrough adjacent the upper end thereof. Further, an arcuate bracket 41 is provided and which is secured to only two upper post members, namely, the upper post members 32, 35 at a location oriented below the aperture set 40. The arcuate bracket 41 has at least two downwardly opening recesses 42 located along an outward downwardly facing arcuate edge 43 thereof. A circularly cross-sectioned hollow bearing sleeve 44 (FIG. 6) is received and secured, as by welding, in the aperture set 40 in each of the upper post members 32, 33, 34, 35.

Figure 6:
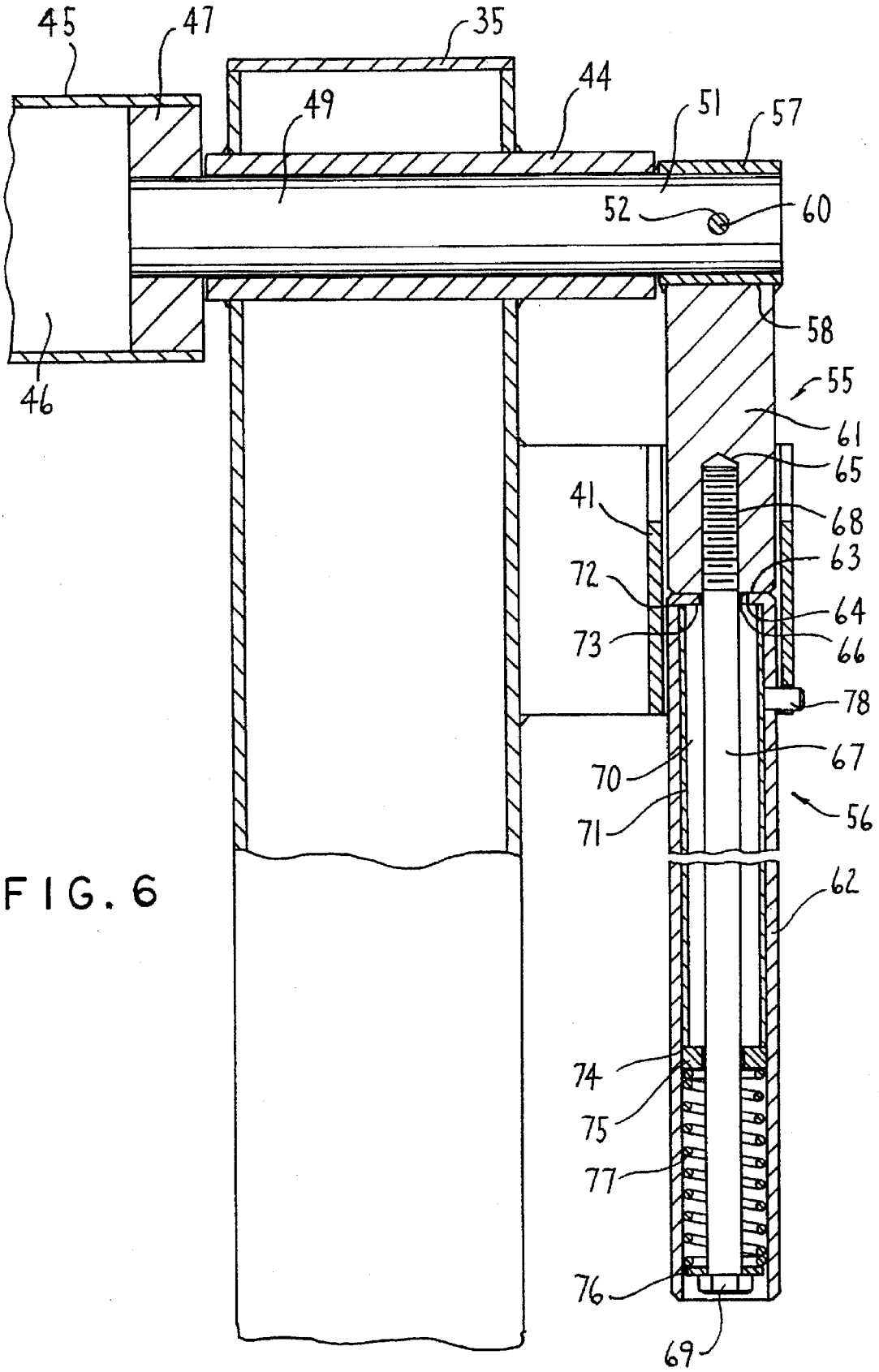
FIG. 6 is a sectional view taken along line 6—6 of FIG. 5.

An elongated shaft member 45 extends between and is rotationally supported in the aligned bearing sleeves 44 in laterally spaced pairs of posts 36 (22, 23), 37 (24, 25). More specifically, each shaft member 45 has an elongated hollow tubular section 46 closed at each end by end caps 47, 48 secured to the tubular section 46. The end caps 47, 48 each have a stub shaft 49 extending outwardly therefrom coaxial with the tubular section 46. Each stub shaft 49 is rotationally received in a respective bearing sleeve 44. The stub shafts 49 received in the bearing sleeves 44 in the upper post members 32, 35 each extend entirely through and beyond the respective bearing sleeve 44. An end section 51 of each stub shaft 49 extending beyond the respective bearing sleeve 44 has a transverse bore 52 extending therethrough (FIG. 6).

Figure 8:
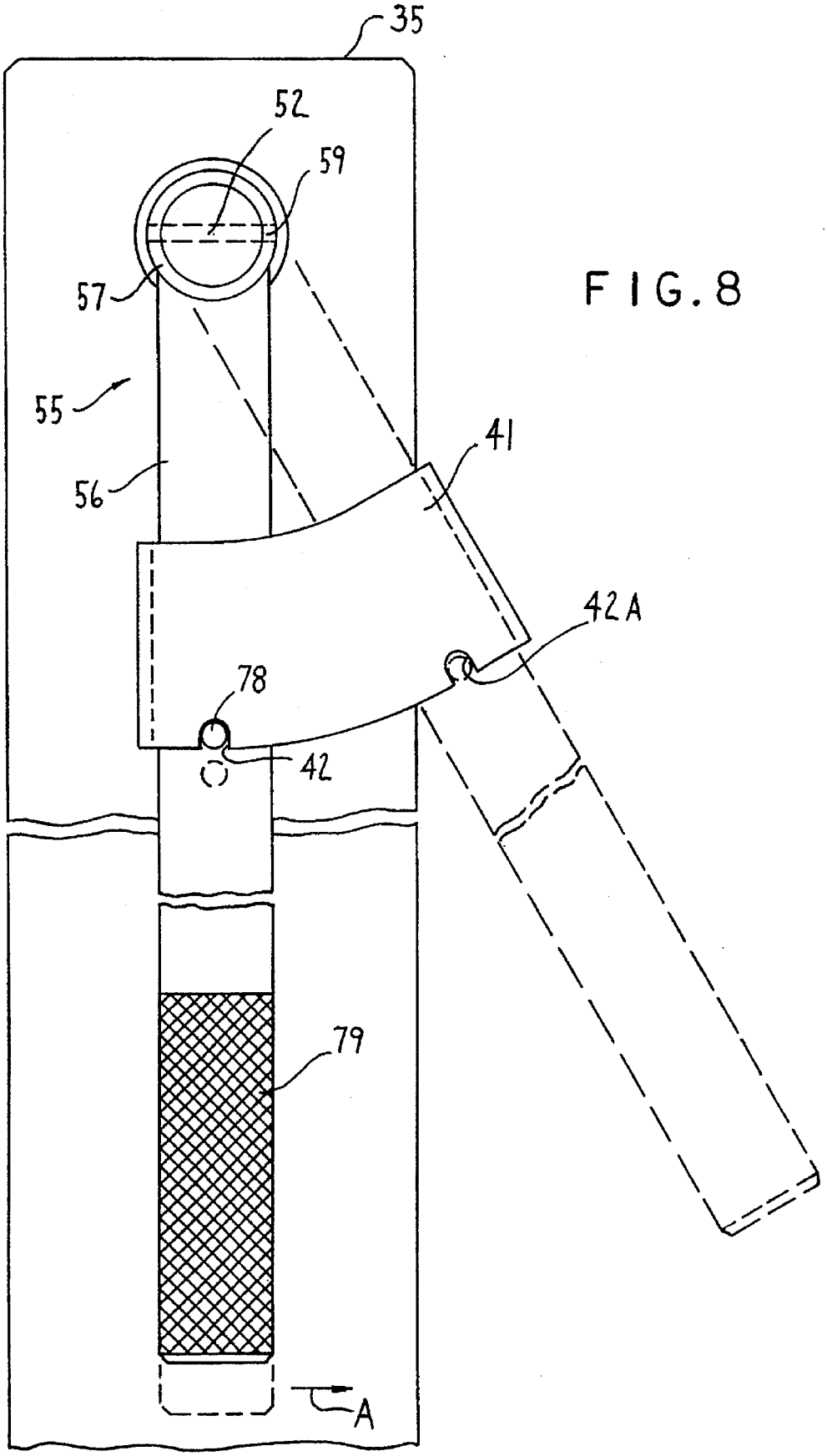
FIG. 8 is an enlarged side view of the upper portion of the post and handle arrangement.
Figure 9:
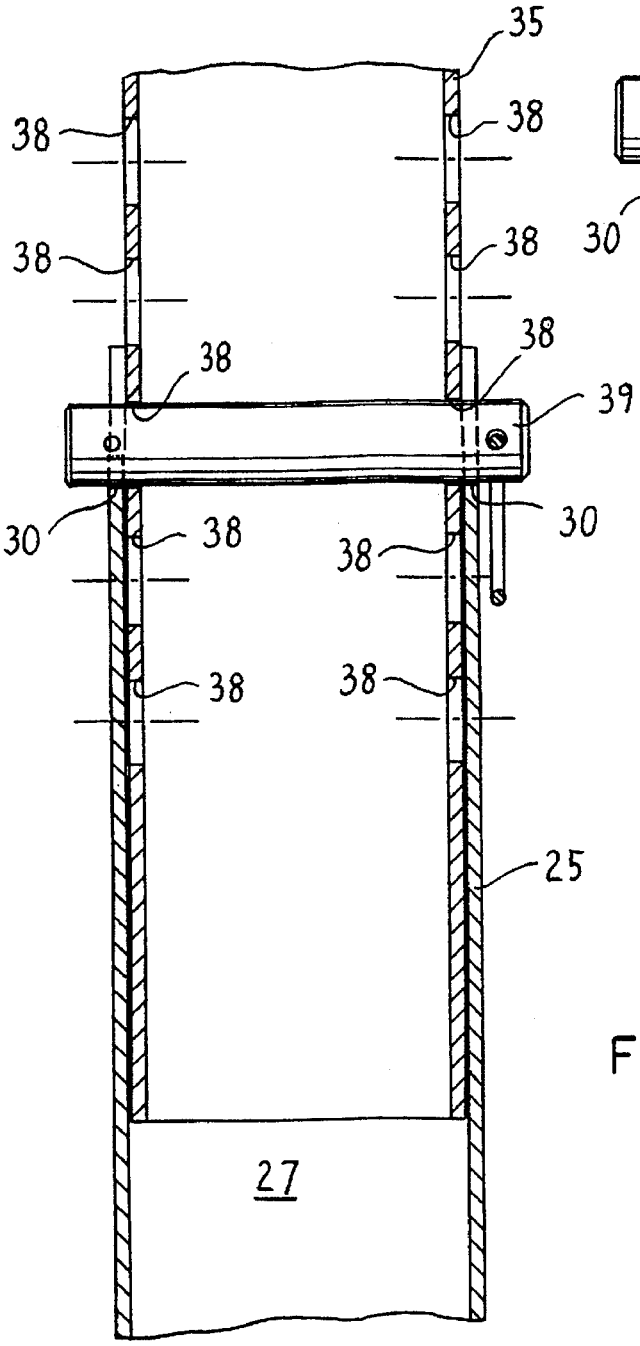
FIG. 9 is a sectional view taken along line 9—9 in FIG. 1.
Figure 10:
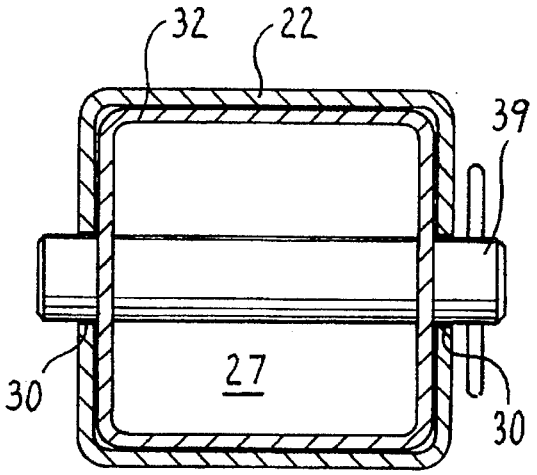
FIG. 10 is a sectional view taken along line 10—10 in FIG. 5.

A control device 55 is secured to each of the two end sections 51 of the stub shafts 49. Each control device 55 includes an elongate handle 56 extending generally radially downwardly from the stub shaft end section 51. The handle 56 has a hollow sleeve 57 located at a proximal end 58 thereof. The sleeve 57 receives the stub shaft end section 51 therein. The sleeve 57 has a radially extending hole 59 therein (FIG. 8). The axis of the hole 59 is oriented so as to be coaxial with the axis of the bore 52 in the stub shaft end section 51. A pin 60 is received in the aligned_bore 52 and hole 59 to thereby effect a securement of the handle 56 to the stub shaft end section 51 (FIG. 6). The handle 56 includes an elongate first section 61 extending from the sleeve 57 and a hollow elongate second section 62 coaxially abutting the first section 61. That is, an end face 63 of the first section 61 abuts an end face 64 of the second section 62. An internally threaded bore 65 extends from the end face 63 into the interior of the first section 61. An aperture 66 in the end face 64 of the second section 62 is coaxial with the bore 65. A threaded end 68 of an elongate bolt 67 is threadedly received in the bore 65. The elongate bolt 67 has a head end 69 distal to the threaded end 68. The bolt 67 extends through the aperture 66 into the interior 70 of the hollow second section 62. A hollow spacer 71 is positioned within the interior 70 of the hollow second section 62 with a proximal end 72 of the spacer 71 contacting an interior face 73 of the second section 62 interiorly adjacent the end face 64. A distal end 74 of the spacer 71 fixedly positions a blocking member 75 within the interior 70 of the second section 62. The blocking member 75 has a centrally disposed hole therethrough which slidably receives the shank of the bolt 67 therein. A washer 76 encircles the bolt 67 and contacts the bolt head end 69. A spring 77 is positioned between the blocking member 75 and the washer 76. A latching peg-like protuberance 78 is secured to and extends outwardly from the second section 62 and is adapted to be received in a selected one of the recesses 42 in the arcuate edge of the bracket 41. The second section 62 also has a gripping surface, such as a knurled surface 79, on the outer peripheral surface of the second section 62 distal the first section 61 which may be gripped by a user (FIG. 8). The spring 77 serves to urge the end faces 63, 64 into abutting relation and to yieldably resist efforts to separate them to facilitate a drawing of the peg 78 from the selected one of the recesses 42.

Figure 7:
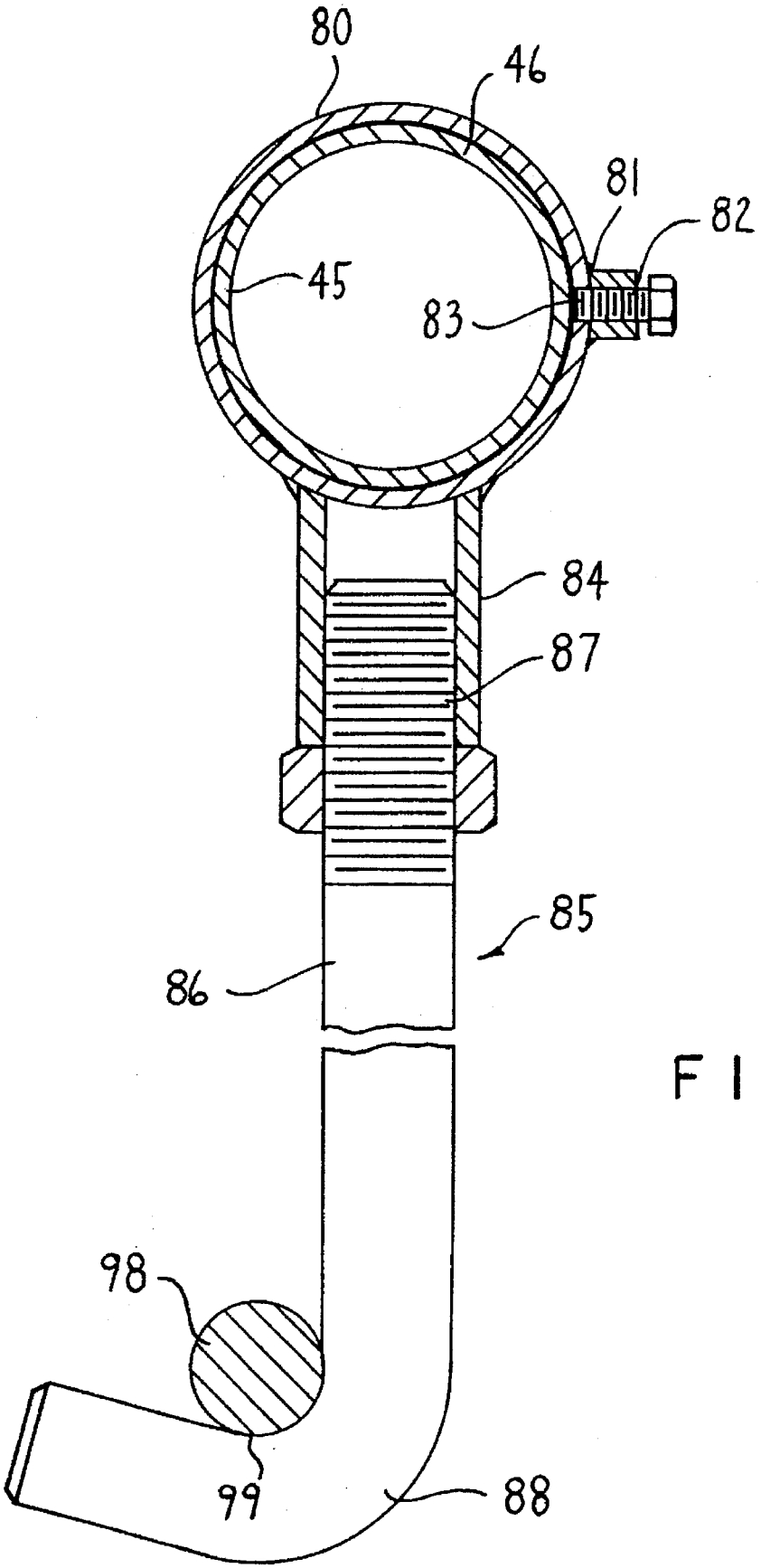
FIG. 7 is a sectional view taken along line 7—7 in FIG. 1.

Adjustable couplings 80 are positioned on both of the elongated shaft members 45 and are slidable along the longitudinal lengths thereof. The couplings 80 each comprise a hollow sleeve with an open interior to receive the shaft members 45 therein. The wall of each of the couplings 80 has a radially extending, internally threaded bore 81 therein which receives a threaded bolt 82 (FIG. 7). The distal end of each of the bolts 82 press against the outer periphery 83 of the shaft members 45 so as to secure the coupling 80 to the shaft member 45. The couplings 80 have a transversely extending, internally threaded portion 84. A J-shaped hook 85 having an elongated stem 86, which is partially externally threaded as at 87, is received in the threaded portion 84 of each coupling 80. The hook 85 also has a curved, upwardly open, cradle part 88 extending transversely to the stem 86.

The use of the terms "front" and "rear" will refer to directions relative to a vehicle, here a truck 96, having the container 21 positioned thereon, or relative to a truck 96 positioned beneath the support apparatus 20 as described hereinafter. The container 21 has conventional structure, namely, a front end wall 91, rear end wall 92, side walls 93, a bottom wall 94, and a generally open top 95. If the container 21 is a particulate spreader, such as a road salt and/or sand spreader, then the spreading device 97 is positioned adjacent the rear end wall 92. Conventional openings, not shown, provide a pathway for particulate, housed within the container 21, to flow to the spreader device. Elongate connector rods 98 extend between and are connected to the side walls 93. In this embodiment, two connector rods 98 are parallel spaced from each other within the container 21 generally corresponding to the spacing between the side-by-side spaced post pairs 22, 25 and 23, 24. The connector rods 98 are generally longitudinally aligned with, but vertically displaced from the shaft member 45. Suspension locations 99 for supporting the container 21 on the support apparatus 20 are defined on the connector rods 98. The connector bars 98, while shown as straight horizontally aligned bars, are not limited thereto. That is, bent bars, for example, bars bent into loops, are also deemed to be within the scope of the invention.

The container 21, when positioned on the truck 96, is held thereon by conventional methods and structure with the bottom wall 94 thereof resting on the truck bed 102. More specifically, the container 21 may be held on the truck bed by the latching mechanism conventionally provided on a typical dump truck for operating the tailgate. The tailgate is not illustrated in the drawings because it is usually removed from the truck 96 when the container 21 is positioned thereon. The container 21 may also be bolted or chained to the truck bed 102. In this particular embodiment, the truck 96 also has an onboard motive device 103 for raising and lowering the truck bed 102, commonly a hydraulic powered piston-cylinder arrangement positioned beneath the truck bed 102 with one end fixed to the truck frame and the other to the truck bed 102. The motive device 103 raises and lowers the truck bed 102 about a truck bed pivot axis 104.

Figure 5:
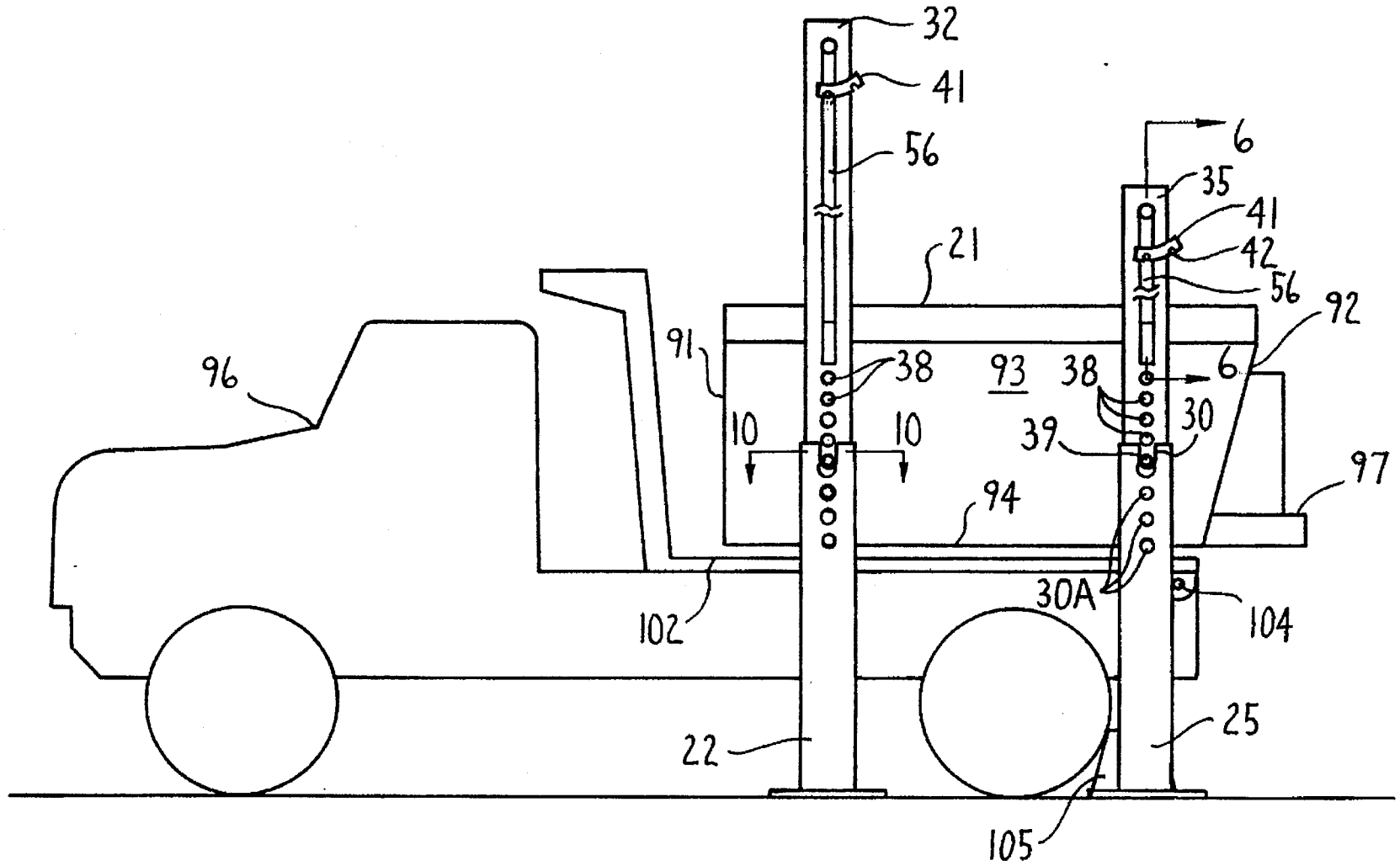
FIG. 5 is a side view of the support apparatus supporting the container above the truck bed.

FIG. 5 shows an alternate embodiment with the lower post member 25 having a plurality of sets of vertically aligned apertures 30A. The apertures 30A coaxially align with the apertures 38 when the upper post member 35 is received in the lower post member 25. One of each of the coaxially aligned apertures 30A, 38 receive the securement pin 39 therethrough to secure the upper post member 35 within the lower post member 25. The apertures 30A in the lower post member allow the support apparatus 20 to adjust to trucks 96 and containers 21 which are shorter in height.

OPERATION

Figure 2:
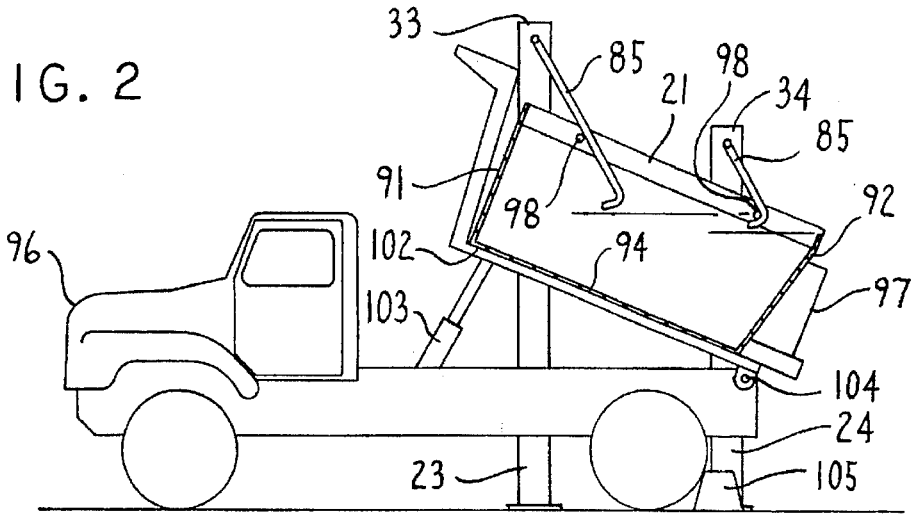
FIG. 2 is a sectional side view showing a first stage in the process of effecting a removal of a container from a truck bed by the support apparatus.
Figure 3:
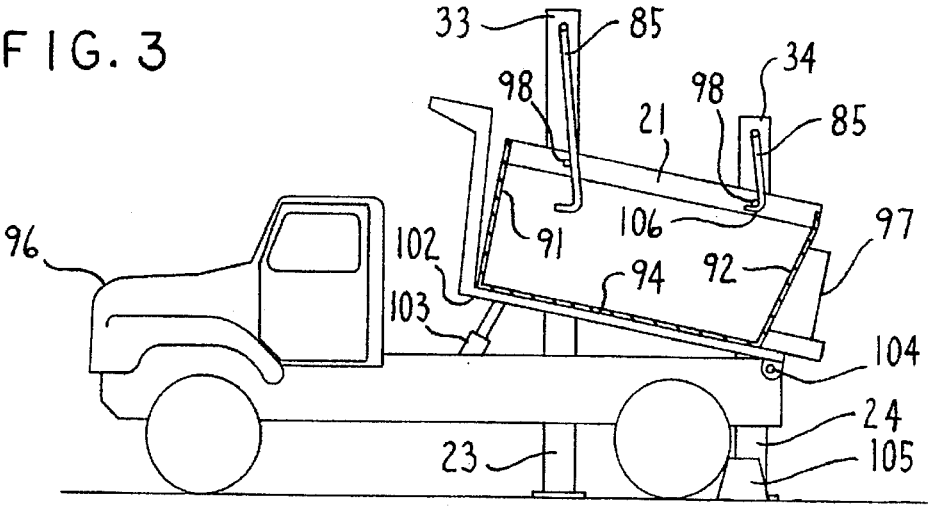
FIG. 3 is a view similar to FIG. 2 showing a second stage in the removal of the container by the support apparatus.
Figure 4:
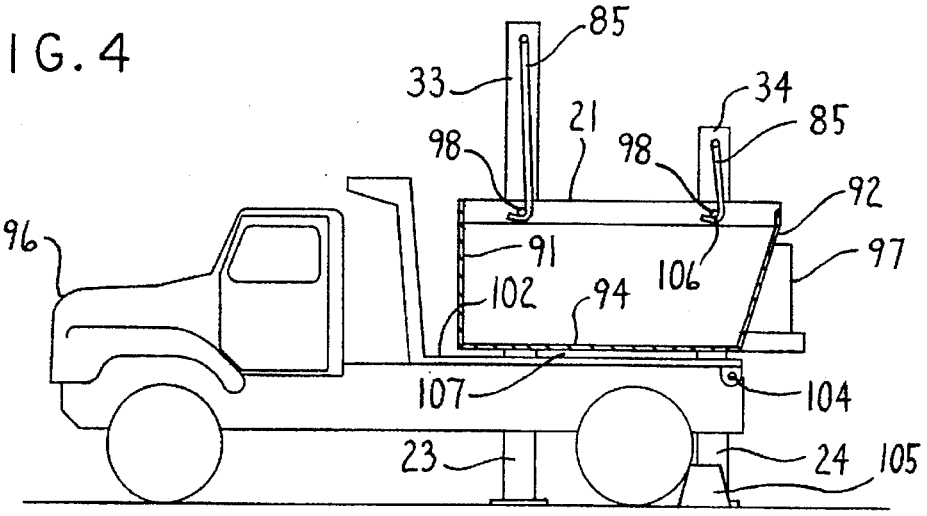
FIG. 4 is a view similar to FIG. 3 showing a final stage of the container being supported by the support apparatus.

The length of the first pair of laterally spaced posts 36 are adjusted so as to be taller than the second pair of laterally spaced posts 37 thereby providing adequate clearance for the walls 91, 92 and 93 on a container 21 mounted on a raised truck bed 102 of a truck 96 to be positioned under the support apparatus 20 (FIGS. 2–4). The length, or height, of each of the posts is adjustable by inserting the securement pin 39 into a select aperture 38 in the upper post member 35 and into the notches 30 of the lower post member 25 to thereby orient each shaft member 45 at a sufficient elevation. This adjustment renders the entire support apparatus 20 adaptable to various truck 96 and container 21 heights and additionally renders the two shaft members 45 horizontally aligned. The front to rear spacing between the post pairs 36 (22, 23) and 37 (24, 25) is determined by the similar spacing between the connector rods 98 inside the container 21. The shaft members 45 are oriented parallel to and directly above the connector rods 98. The couplings 80 are initially adjustably positioned along the length of the shaft member 45 and are laterally spaced from one other. Each coupling 80 is secured to the shaft member 45 by the bolt 82 pressing against the outer periphery 83 of the shaft member 45. The couplings 80 are usually spaced apart a sufficient distance to prevent instability in the support of the container 21 when the container 21 is positioned on the support 20. The J-shaped hooks 85 are adjustable in length relative to the shaft member 45 by rotating the threaded portion 87 of the stem 86 into the transversely extending, threaded portion 84 of the coupling 80 to facilitate horizontal alignment therebetween when the posts are standing on an irregular floor surface. The hooks 85 received in couplings 80 secured to the shaft member 45 extending between the first pair of laterally spaced posts 36 are longer than the hooks 85 associated with the second pair of laterally spaced posts 37 so that the curved cradle parts 88 of the hooks 85 are generally at the same height relative to the ground so as to support the container 21 thereon in a level orientation. The level orientation, and width between the couplings 80, provides a stable support of the container thereon.

When it is desired to remove a container 21 from the truck bed 102, an operator must first rotate the hooks 85 into a first position out of the travel path of the container 21 on the truck bed 102. This is accomplished by the operator engaging or gripping the handle 56 of the control device 55 and pulling the second section 62 downwardly against the biasing force of the spring 77 within the hollow second section 62. The latching peg 78 will move out of one recess 42 in the bracket 41 as shown in broken lines in FIG. 8 so that the operator can now move the handle 56 in the direction of the arrow A about the axis of rotation of the stub shaft 49 to effect a rotation of the shaft member 45 connected thereto. The hooks 85 are also moved by the rotational movement of couplings 80 fixedly secured on the shaft member 45 so that they become removed from the path of the container 21 when the truck 96 with raised bed 102 is backed beneath the shaft members 45 and between the two pairs of posts 36, 37 (FIG. 2). The hooks 85 are held in this moved away position by the peg 78 being received in a remote select recess 42A, in the bracket 41.

A wheel stop 105 may be provided to indicate to the operator where to stop the truck 96 when backing beneath the shaft members 45. When the rear wheels of the truck abut the stop 105, the operator raises the truck bed 102, using the motive device 103, to the position shown in FIG. 2. Thereafter, the operator releases the peg 78 from the remote recess 42A by again gripping the handle 56 and pulling the second section 62 with attached peg 78 downwardly and moving the handle toward the initial position until the stems 86 of the hooks 85 engage the connector rods 98 (FIG. 2) thereby placing the hooks in an intermediate position. The truck bed 102 is thereafter lowered using the motive device 103 onboard the truck 96 until the hooks 85 on the shaft member 45 extending between the second pair of posts 37 receive the rear connector rod 98 in the cradle part 88 (FIG. 3). At this time, the front connector rod 98 is still adjacent the stems 86 of the hooks 85 on the shaft member 45 extending between the first pair of posts 36. If a latching mechanism or other means securing the container 21 to the truck bed 102 is present, then it is now released so that it no longer secures the container 21 to the truck bed. The pivot axis of the container 21 changes from the truck bed pivot axis 104 to a support pivot axis 106. The support pivot axis 106 is generally defined by the cusp of the cradle part 88 of the hooks 85 on the shaft member 45 extending between the second pair of posts 37. The support pivot axis 106 generally extends along the longitudinal length of the rear connector rod 98 when received in the rear set of hooks 85 provided with the second pair of posts 37. Thereafter, the truck bed 102 is further lowered about the truck bed pivot axis 104. The rear portion of the container 21 now becomes vertically separated from the truck bed 102 and is supported at the suspension locations 99 on the rear connector rod 98 defined by the contact location with the hooks 85 associated with the second pair of posts 37. Further lowering of the truck bed 104 results in the front portion of the container 21 becoming supported at suspension locations 99 on the front connector rod 98 defined by the contact location with the hooks 85, and a complete separation of the container 21 from the truck bed 102 occurs to define a gap 107 (FIG. 4)

between the truck bed 102 and the bottom wall 94 of the container 21. At this time, the container 21 is completely supported on the support apparatus 20 (FIGS. 1, 4 and 5) and with the hooks 85 in a second position. At this location, the pegs 78 are again received in the notches 42 as shown in solid lines in FIG. 8. The container 21 is now supported in a level relationship relative to the ground on container support apparatus 20.

Electrical connections between the container and the truck, if any, may be disconnected at any time. The truck is now free for other uses. The container 21 may be placed back upon the truck bed 102 by reversing the above procedure.

Although a particular preferred embodiment of the invention has been disclosed in detail for illustrative purposes, it will be recognized that variations or modifications of the disclosed apparatus, including the rearrangement of parts, lie within the scope of the present invention.

The embodiments in the invention in which an exclusive property or privilege is claimed are defined as follows:

1. A particulate cargo container support for supporting a particulate cargo container and for facilitating a placement thereof onto and removal from a truck bed, said truck bed including a truck bed pivot axis, by using only an on-board motive force applied to the truck bed for raising and lowering the truck bed about the truck bed pivot axis, said particulate cargo container having a first end wall, a second end wall, interconnected side walls, a bottom wall, an open top, and spaced pairs of connectors connected to said container to define suspension locations located adjacent the respective first and second end walls, said support comprising:

a plurality of side-by-side, laterally spaced, pairs of upright members standing on a floor surface;

a bearing adjacent a top of each of said plurality of upright members;

shaft members extending between each side-by-side pair of said upright members, said shaft members being rotationally received in respective said bearings;

a plurality of laterally spaced pairs of hook means on each of said shaft members, each of said hook means having means thereon for defining a cradle and means thereon for facilitating a securement to said shaft members; and control means for effecting a movement of each of said hook means and said cradle thereon between at least two positions, a first position of said at least two positions orienting each cradle out of a path of movement of said connectors which move with and in response to a raising and lowering of said truck bed about the truck bed pivot axis, a second position of said at least two positions orienting each cradle in the path of movement of said connectors to facilitate a reception of said connectors into said cradles, a first pair of said plurality of laterally spaced pair of hook means being oriented closer to said first end wall of said particulate cargo container, a second pair of said plurality of laterally spaced pairs of hook means being oriented closer to said second end wall of said particulate cargo container than said first pair of said hook means, whereby as said truck bed is moved from a raised position toward a lowered position, said pair of connectors adjacent said second wall will enter said cradles on said second pair of hook means to cause a rear part of said container to become suspended from said suspension locations located thereat and a change of the pivot axis for said container to a further pivot axis separate from said truck bed pivot axis until said pair of connectors adjacent said first end wall enter said first pair of hook means, at which time a continued lowering of said truck bed will effect a vertical separation to occur between said bottom wall of said container and said truck bed.

2. The particulate cargo container support according to claim 1, wherein said hook means includes a plurality of hooks each being secured to a respective one of a plurality of couplings mounted on said shaft members and adapted to engage the suspension locations of the particulate cargo container, each said coupling including a hollow sleeve receiving a respective one of said shaft members therein and defining said means for facilitating a securement, a hook receiving portion provided on said hollow sleeve receiving a said hook therein, a threaded bore, and a bolt being received in said threaded bore, an end of said bolt being adapted to press against a peripheral surface of said shaft member when received in said threaded bore so as to secure each said coupling to said shaft member.

3. The particulate cargo container support according to claim 2, wherein each of said couplings includes means for facilitating an elevational adjusting of said cradles of said hooks and radial adjustment relative to a respective one of said shaft members.

4. The particulate cargo container support according to claim 1, further comprising a plurality of couplings slidable along the length of a respective said shaft member, and each of said couplings have a means for fixedly securing said couplings to said shaft member, said couplings defining said means for facilitating securement.

5. The particulate cargo container support according to claim 1, wherein said further pivot axis is defined by said cradles on said second pair of hook means.

6. The particulate cargo container support according to claim 1, wherein said control means includes a handle mechanism fixedly secured to an end of each said shaft member, wherein a bracket with recesses in a side thereof is positioned on said upright members adjacent said handle mechanism, a peg-like protuberance extends outwardly from said handle mechanism and is adapted to be received in a selected one of said recesses in said bracket, and wherein said handle mechanism has a means for yieldably resisting removal of said peg-like protuberance from said recesses in said bracket allowing said handle mechanism to rotate said shaft member.

7. The particulate cargo container support according to claim 6, wherein said handle mechanism includes first and second elongate handle sections abutting each other, wherein said means for yieldably resisting removal of said peg-like protuberance from said recesses in said bracket includes an elongate bolt member joining said first and second elongate handle sections together, said first handle section being secured to said end of said shaft member, said second handle section having said peg-like protuberance extending outwardly therefrom and being hollow with a spring positioned therein to yieldably urge said second handle section against said first handle section, said spring also yieldably urging said peg-like protuberance into one said recess in said bracket.

8. The particulate cargo container support according to claim 1 wherein a first of said plurality of pairs of upright members supports a first said shaft member therebetween, a first of said plurality of pairs of hook means operatively engaging said first shaft member, said first pair of upright members supporting said first shaft member at a height sufficient to allow a raised said truck bed with said container thereon beneath said first shaft member, and wherein a second of said plurality of pairs of upright members supports a second said shaft member therebetween, a second of said plurality of pairs of hook means operatively engaging said second shaft member, said second pair of upright members supporting said second shaft member at a height sufficient to allow a raised said truck bed with said container thereon beneath said second shaft member, said first pair of upright members having a greater height than said second pair of upright members.

9. The particulate cargo container support according to claim 8 wherein said first pair of hook means are longer than said second pair of hook means, and wherein said cradles of said first and second pairs of hook means are at a same height above the floor surface.

10. A method for removing a particulate cargo container from a truck bed of a truck utilizing an on-board motive force for raising and lowering the truck bed, comprising the steps of:

positioning first and second side-by-side laterally spaced pairs of upright members at a sufficient width to allow a truck with a particulate cargo container to be positioned therebetween;

positioning a first and a second shaft member between a respective first and second side-by-side laterally spaced pair of upright members at a sufficient height to allow the truck with the particulate cargo container positioned on a raised bed of the truck to be positioned thereunder;

positioning a first hook means and a second hook means on respective first and second said shaft members for supporting the particulate cargo container;

orienting the particulate cargo container beneath the first and second shaft members;

moving both the first and second hook means into a raised position to thereby allow the particulate cargo container to be moved with the truck bed to a raised position pivoted about a truck bed pivot axis;

raising the truck bed with the particulate cargo container thereon to the raised position;

moving said first and second hook means from the raised position toward a lowered position so as to effect movement of the second hook means to a position defining a hook pivot axis at a cradle on the second hook means;

lowering the truck bed with the particulate cargo container thereon toward a lowered position;

changing the pivot axis of the particulate cargo container from the truck bed pivot axis to the hook pivot axis in response to a lowering of the truck bed caused by the second hook means receiving and supporting the particulate cargo container; and further lowering the truck bed until said first hook means supports the particulate cargo container above the lowermost position of the truck bed to thereby facilitate a vertical separation between the particulate cargo container and the lowered truck bed, the particulate cargo container thereafter being supported solely on the first and second hook means.

11. The method according to claim 10, further comprising the step of locking said first and second hook means in the raised position by releasably securing a handle attached to a respective said shaft member in a locking device so as to allow a truck with a particulate cargo container to move under said first and second hook means.

12. The method according to claim 11, wherein the step of changing the pivot axis of the particulate cargo container from the truck bed pivot axis to the hook pivot axis includes the step of releasing the particulate cargo container from securement to the truck bed.

* * * * *